US007182486B1

(12) United States Patent
Miracle

(10) Patent No.: US 7,182,486 B1
(45) Date of Patent: Feb. 27, 2007

(54) HALOGEN FLOOR LAMP WITH AMBIENT LIGHT DISPLAY

(76) Inventor: Mark N. Miracle, N69 W533 Margie La., Cedarburg, WI (US) 53012

( * ) Notice: Subject to any disclaimer, the term of this patent is extended or adjusted under 35 U.S.C. 154(b) by 174 days.

(21) Appl. No.: 11/051,584

(22) Filed: Feb. 4, 2005

(51) Int. Cl.
*F21V 7/00* (2006.01)

(52) U.S. Cl. ..... 362/346; 362/364; 362/367

(58) Field of Classification Search ..... 362/147, 362/346, 364, 367, 404, 410, 414, 420, 424
See application file for complete search history.

(56) References Cited

U.S. PATENT DOCUMENTS

| | | | | | |
|---|---|---|---|---|---|
| 1,978,251 | A | * | 10/1934 | Doane | 362/346 |
| 2,087,750 | A | | 7/1937 | Bookman, Jr. | |
| 2,567,336 | A | | 9/1951 | Hendricks | |
| 2,899,543 | A | | 8/1959 | Rasmussen | |
| 3,115,310 | A | | 12/1963 | Holfman | |
| D206,610 | S | | 1/1967 | Klausen | |
| 3,805,051 | A | * | 4/1974 | Rambauske | 362/346 |
| 3,886,349 | A | | 5/1975 | Arai | |
| 4,231,080 | A | * | 10/1980 | Compton | 362/298 |
| 4,450,513 | A | | 5/1984 | Guggemos | |
| 4,667,278 | A | | 5/1987 | Poyer | |
| D290,754 | S | | 7/1987 | Kira | |
| 4,686,612 | A | * | 8/1987 | Pringle et al. | 362/297 |
| 4,750,097 | A | * | 6/1988 | Pringle et al. | 362/297 |
| 5,055,987 | A | | 10/1991 | Ellson et al. | |
| 5,057,978 | A | * | 10/1991 | Conti | 362/125 |
| D328,800 | S | | 8/1992 | Cooper | |
| 5,156,454 | A | | 10/1992 | White | |
| D364,001 | S | | 11/1995 | Lieberman et al. | |
| 5,599,091 | A | | 2/1997 | Kira | |
| 5,702,180 | A | | 12/1997 | Huang | |
| 5,800,054 | A | | 9/1998 | Lo | |
| D399,334 | S | | 10/1998 | Lo | |
| D437,956 | S | | 2/2001 | Cogliano et al. | |
| D446,329 | S | | 8/2001 | Lau | |
| 6,386,729 | B1 | | 5/2002 | Bober | |
| 6,582,104 | B2 | | 6/2003 | Miller et al. | |
| D487,811 | S | | 3/2004 | Stauffer | |
| 6,758,581 | B2 | * | 7/2004 | Weinhuber | 362/285 |
| 6,779,907 | B2 | * | 8/2004 | Beadle | 362/145 |
| 2005/0036321 | A1 | * | 2/2005 | Ward | 362/365 |

* cited by examiner

*Primary Examiner*—Sandra O'Shea
*Assistant Examiner*—Anabel Ton
(74) *Attorney, Agent, or Firm*—Andrus, Sceales, Starke & Sawall, LLP

(57) ABSTRACT

A lamp assembly for providing ambient light display includes an intermediate hollow cylinder. A front hollow cylinder is removably attached and extends from one end of the intermediate cylinder. A rear hollow cylinder is integrally joined to and extends from an opposite end of the intermediate cylinder. The rear cylinder supports a light fixture connected to a source of electrical power from an inner wall thereof. The light fixture receives a light bulb which projects into an interior of the intermediate cylinder. The front cylinder is attached to the intermediate cylinder to define a first circular gap between the front cylinder and the intermediate cylinder. The rear cylinder is joined to the intermediate cylinder to create a second circular gap between the rear cylinder and the intermediate cylinder such that when the light bulb is energized, ambient light is emitted directly through the front cylinder, the rear cylinder, and the first and second circular gaps.

13 Claims, 2 Drawing Sheets

FIG. 1
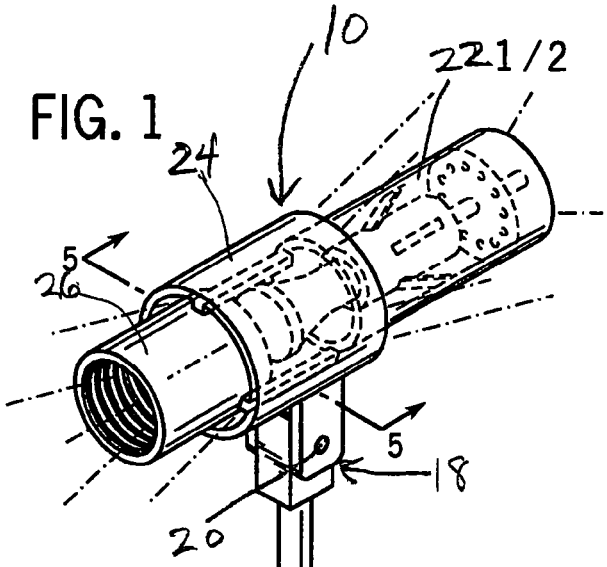
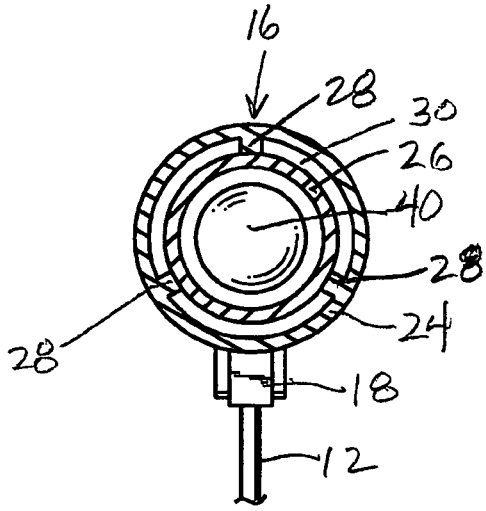
FIG. 5
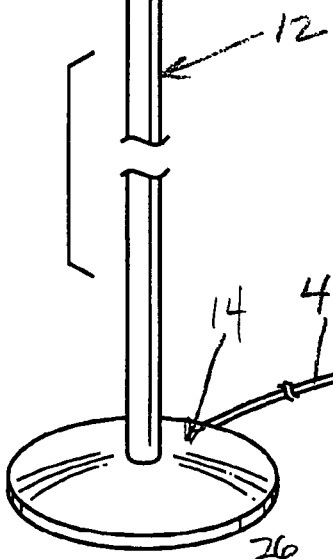
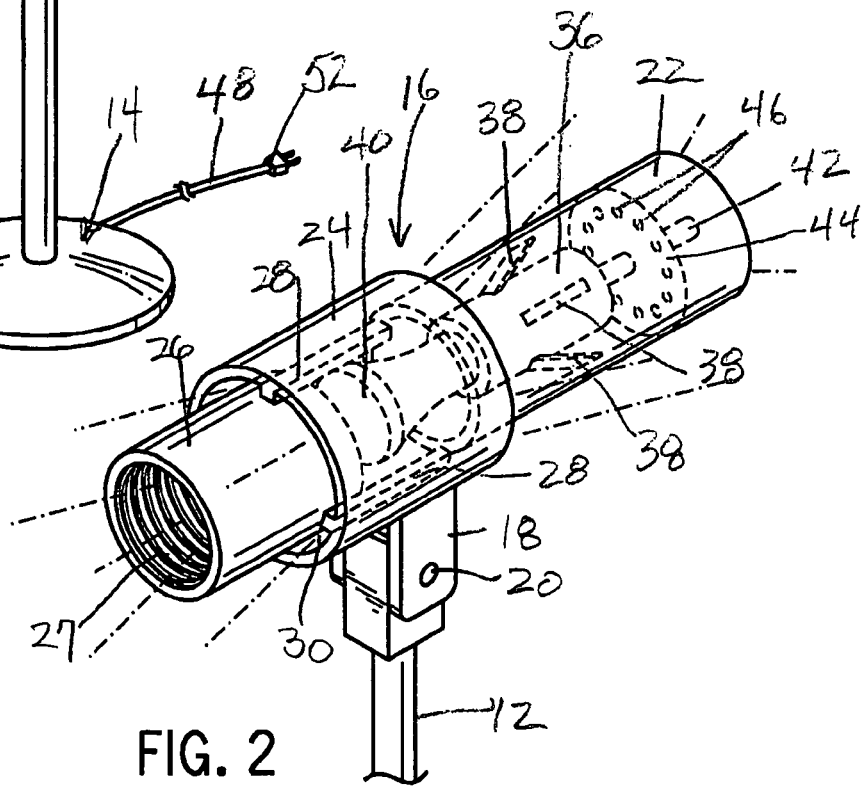
FIG. 2

HALOGEN FLOOR LAMP WITH AMBIENT LIGHT DISPLAY

FIELD OF THE INVENTION

The present invention relates generally to illumination devices and, more particularly, pertains to a halogen floor lamp which provides an enhanced dispersion of light in various directions.

BACKGROUND OF THE INVENTION

Various devices for light projection are known in the prior art. Many of these devices rely upon a construction of wings, reflectors, deflectors, louvers, shades and the like to produce a decorative and functional light transmission or distribution in one or more directions. As a result, some lighting appliances become overly complicated and expensive to manufacture.

It remains desirable to provide an illumination device which is simplified in structure, and which provides an improved, aesthetically-pleasing, ambient light display.

SUMMARY OF THE INVENTION

It is a general object of the present invention to provide a lamp assembly which will directly transmit light rays without glare from front, rear and peripheral portions thereof.

It is also an object of the present invention to provide an ornamental, ambient lighting device in the form of a halogen floor lamp.

It is a further object of the present invention to provide a lamp assembly which does not require any specialized internal structure to redirect or intensify light.

In one aspect of the invention, a lamp assembly provides an ambient light display and includes an intermediate hollow cylinder. A front hollow cylinder is removably attached to and extends from one end of the intermediate cylinder. A rear hollow cylinder is integrally joined to and extends from an opposite end of the intermediate cylinder. The rear cylinder supports a light fixture connected to a source of electrical power from an inner wall thereof. The light fixture receives a light bulb which projects into an interior of the intermediate cylinder. The front cylinder is attached to the intermediate cylinder to define a first circular gap between the front cylinder and the intermediate cylinder. The rear cylinder is joined to the intermediate cylinder to create a second circular gap between the rear cylinder and the intermediate cylinder such that when the light bulb is energized, ambient light is emitted directly through and out of the front cylinder, the rear cylinder and the first and second circular gaps.

The intermediate cylinder has an inner wall formed with a series of engagement surfaces. An outer wall of the front cylinder is frictionally engaged and held within the intermediate cylinder by the engagement surfaces. An inner wall of the front cylinder is formed with a series of anti-glare ridges. The intermediate cylinder is movably attached to a vertical pole having a base. The rear cylinder has a length which is longer than lengths of the front cylinder and the intermediate cylinder. The intermediate cylinder has a diameter which is greater than the diameters of the front cylinder and the rear cylinder. The light fixture includes an elongated on/off switch projecting rearwardly in a direction opposite the light bulb. The on/off switch is recessed within the rear cylinder. A heat and light dispersing plate is mounted on the on/off switch and lies across an interior of the rear cylinder. In the preferred embodiment, the light bulb is a halogen bulb.

In another aspect of the invention, a lamp assembly is adjustably mounted on a pole having a base adapted to rest on a support surface. The lamp assembly includes an intermediate hollow cylinder having an inner wall formed with a series of longitudinally extending, spaced apart ribs. A front hollow cylinder is removably attached and extends from one end of the intermediate cylinder. The front cylinder has an outer wall frictionally engageable with the ribs of the intermediate cylinder. A rear hollow cylinder is integrally joined to and extends from an opposite end of the intermediate cylinder. The rear cylinder supports a light fixture connected to a source of electrical power from an inner wall thereof. The light fixture receives a light bulb which projects into an interior of the intermediate cylinder. The front cylinder is frictionally engaged with the intermediate cylinder to define a first circular gap between the front cylinder and the intermediate cylinder. The rear cylinder is joined to the intermediate cylinder to create a second circular gap between the rear cylinder and the intermediate cylinder such that when the light bulb is energized, ambient light is emitted directly through and out of the front cylinder, the rear cylinder and through the first and second circular gaps. The intermediate, front and rear cylinders are constructed of a rigid, non-transparent material. The light fixture is connected to the inner wall of the rear cylinder by bracket structure.

Various other objects, features and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIG. 1 is a front perspective view of a multi-directional, light-dispersing, halogen floor lamp embodying the present invention;

FIG. 2 is an enlarged front perspective view of the lamp assembly in FIG. 1.;

FIG. 5 is a cross-sectional view taken on line 5—5 of FIG. 1.

DETAILED DESCRIPTION OF THE INVENTION

Figure 3:
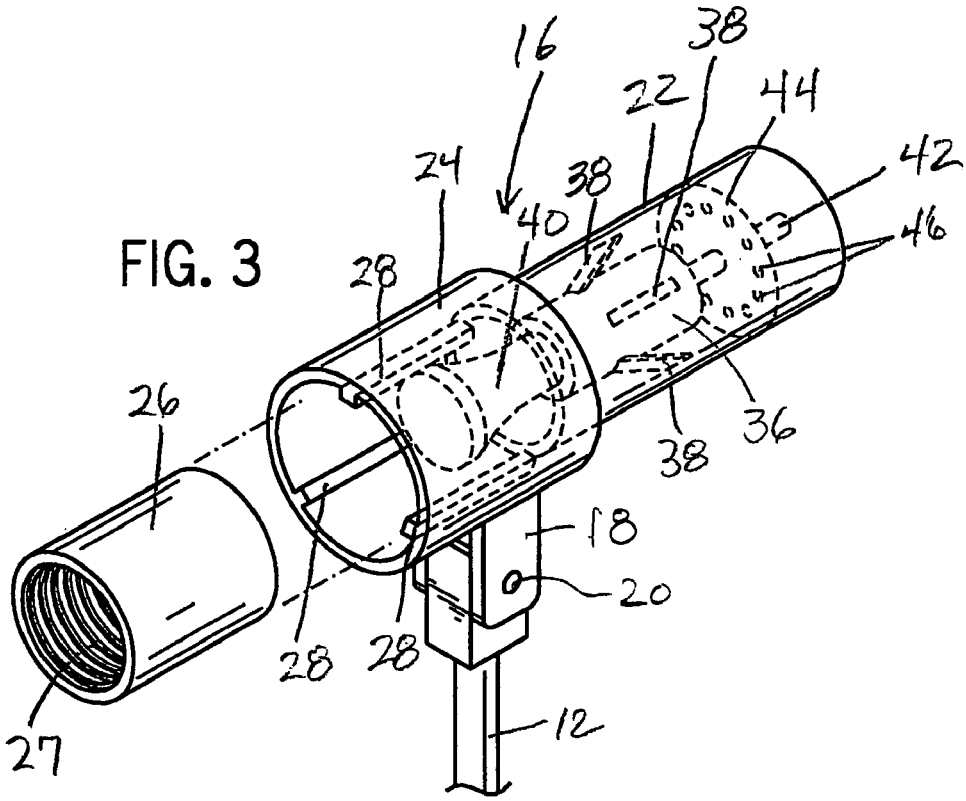
FIG. 3 is a perspective view like FIG. 2 showing a front portion of the lamp assembly removed therefrom.

Referring now to the drawings, FIGS. 1–5 illustrate a halogen floor lamp 10 capable of dispersing high intensity, ambient or multi-directional light in accordance with the present invention. The lamp 10 is generally comprised of a polished steel pole 12 having a weighted, painted base 14 at its lower end, and a lamp assembly 16 attached to a hinged connector 18 at its upper end. The connector 18 permits the lamp assembly 16 to tilt upwardly and downwardly about pivot point 20, and also allows the lamp assembly 16 to swivel or rotate in a circular motion about the longitudinal axis of the pole 12.

The lamp assembly 16 includes a rear hollow cylinder 22 integrally joined to an intermediate hollow cylinder 24 having a generally greater diameter than the rear cylinder 22.

A front hollow cylinder 26 is removably connected to and extends from one end of the intermediate cylinder 24. Front cylinder 26 is formed with a diameter which is substantially equal to the diameter of the rear cylinder 22. An inner wall of the front cylinder 26 is configured with a number of blackened, anti-glare ridges 27 throughout its length. In the preferred embodiment, the rear cylinder 22 is designed with a length which is generally longer than the lengths of the intermediate and front cylinders 24, 26, respectively.

Figure 4:
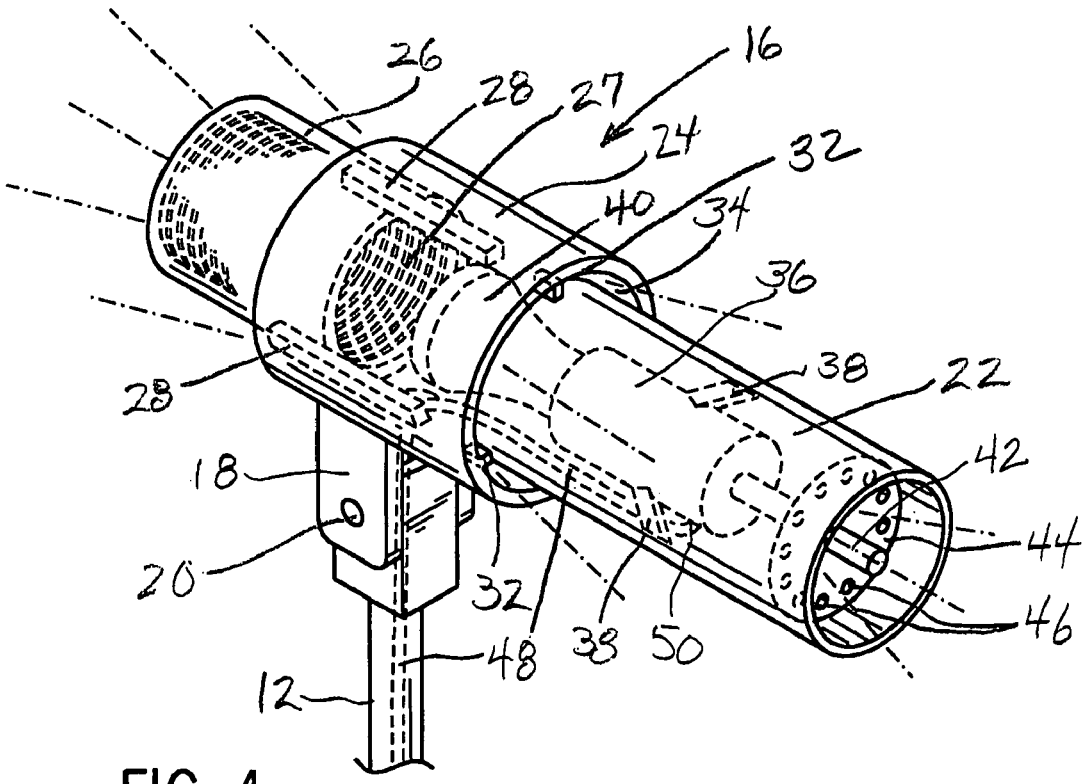
FIG. 4 is a rear perspective view of the lamp assembly.

An inner wall of the intermediate cylinder 24 is provided with a series of three longitudinally extending, equally spaced apart ribs 28 which project inwardly. The ribs 28 extend from the front end of the intermediate cylinder 24 and terminate short of the back end of the intermediate cylinder. The ribs 28 define a frictional engagement surface for an outer wall of the front cylinder 26 which is selectively telescoped into and out of the intermediate cylinder 24. As seen in FIG. 5, when the front cylinder 26 is held in frictional engagement with the ribs 28, a first circular gap 30 is created between the outer wall of the front cylinder 26 and the inner wall of the intermediate cylinder 24 at the front end thereof. As seen in FIG. 4, a front end of rear cylinder 22 is fixedly received and molded into the back end of intermediate cylinder 24 at nibs 32. This creates a second circular gap 34 (FIG. 4) between an outer wall of the rear cylinder 22 and the inner wall of the intermediate cylinder 24 at the back end thereof.

A light fixture 36 is centrally secured within the rear cylinder 22 by support brackets 38 extending between the light fixture 36 and an inner wall of the rear cylinder 22. The front end of light fixture 36 accommodates a halogen light bulb 40 which projects into the interior space of the intermediate cylinder 24. A rear end of the light fixture 36 is provided with an elongated on/off switch 42 having an outer end which is recessed within the back end of rear cylinder 22. A circular plate 44 is mounted upon the on/off switch 42 so that it is spaced inwardly from the outer end of switch 42, and lies across the interior of rear cylinder 22. The plate 44 is formed about is periphery with a plurality of heat and light dispersing holes 46. A cord 48 has one end 50 connected to the light fixture 36, and an opposite end 52 which is in communication with a source of electrical power, such as a wall outlet, for powering the bulb 50. The cord 48 is suitably routed through the lamp assembly 16, the connector 18, the pole 12 and the base 14.

In use, actuating the switch 42 will cause the halogen bulb 40 to emit light rays which create an eye-pleasing, aesthetic, ambient lighting effect from surrounding portions of the lamp assembly 16. More particularly, the light shines forwardly out of the front cylinder 26 and rearwardly through the peripheral holes 46 in plate 44 fixed in rear cylinder 22. Excess heat generated by bulb 40 will also be dispersed through the holes 46. In addition, light is distributed through the first and second circular gaps 30, 34 at the front and rear ends, respectively, of the intermediate cylinder 24 to provide a peripheral, lateral lighting glow in a dark room. The anti-glare ridges 27 on the inside of the front cylinder 26 help moderate the strongest light beams directed forwardly from the bulb 40, and provide balance to the overall lighting effect. Such effect is conveniently provided without requiring a special reflector structure. When it is desired to change the bulb 40, the front cylinder 26 is easily detached or pulled out of frictional engagement with the ribs 28 in internal cylinder 24. Following replacement of the bulb 40, the front cylinder 26 is secured back into the frictional engagement with the ribs 28.

While the lamp assembly 16 is illustrated as being adjustably mounted on a pole 12 and used as a floor lamp 10, it should be appreciated that the lamp assembly 16 may be otherwise installed such as a track light or table lamp.

While the invention has been described with reference to a preferred embodiment, those skilled in the art will appreciate that certain substitutions, alterations and omissions may be made without departing from the spirit thereof. Accordingly, the foregoing description is meant to be exemplary only and should not be deemed limitative on the scope of the invention set forth with the following claims.

I claim:

1. A lamp assembly for providing an ambient light comprising:

an intermediate hollow cylinder having opposite open ends;

a front hollow cylinder removably attached to and extending from one end of the intermediate cylinder, the front hollow cylinder having opposite open ends, and a rear hollow cylinder integrally joined to and extending from an opposite end of the intermediate cylinder, the rear hollow cylinder having opposite open ends and supporting a light fixture connected to a source of electrical power from an inner wall thereof, and the light fixture receiving a light bulb which projects into an interior of the intermediate cylinder, wherein the front cylinder is attached to the intermediate cylinder to define a first circular gap between the front cylinder and the intermediate cylinder, and wherein the rear cylinder is joined to the intermediate cylinder to create a second circular gap between the rear cylinder and the intermediate cylinder such that when the light bulb is energized, ambient light is emitted directly through the open ends of the front cylinder and the rear cylinder and through the first and second circular gaps, and wherein the intermediate cylinder has an inner wall formed with a series of engagement surfaces.

2. The lamp assembly of claim 1, wherein an outer wall of the front cylinder is frictionally engaged and held within the intermediate cylinder by the engagement surfaces.

3. The lamp assembly of claim 1, wherein an inner wall of the front cylinder is formed with a series of anti-glare ridges.

4. The lamp assembly of claim 1, wherein the intermediate cylinder is movably attached to a vertical pole having a base.

5. The lamp assembly of claim 1, wherein the rear cylinder has a length which is longer than lengths of the front cylinder and the intermediate cylinder.

6. The lamp assembly of claim 1, wherein the intermediate cylinder has a diameter which is greater than diameters of the front cylinder and the rear cylinder.

7. The lamp assembly of claim 1, wherein the light bulb is a halogen bulb.

8. The lamp assembly of claim 1, wherein the light fixture includes an elongated on/of switch projecting rearwardly in a direction opposite the light bulb.

9. The lamp assembly of claim 8, wherein the on/off switch is recessed within the rear cylinder.

10. The lamp assembly of claim 9, wherein a heat and light dispersing plate is mounted on the on/off switch and lies across an interior of the rear cylinder.

11. A lamp assembly adjustably mounted on a pole having a base adapted to rest on a support surface, the lamp assembly comprising:

an intermediate hollow cylinder having an inner wall formed with a series of longitudinally extending, spaced apart ribs;

a front hollow cylinder removably attached to and extending from one end of the intermediate cylinder, the front cylinder having an outer wall frictionally engageable with the ribs of the intermediate cylinder; and a rear hollow cylinder integrally joined to and extending from an opposite end of the intermediate cylinder, the rear cylinder supporting a light fixture connected to a source of electrical power from an inner wall thereof, the light fixture receiving a light bulb which projects into an interior of the intermediate cylinder, wherein the front cylinder is frictionally engaged with the intermediate cylinder to define a first circular gap between the front cylinder and the intermediate cylinder, and wherein the rear cylinder is joined to the intermediate cylinder to create a second circular gap between the rear cylinder and the intermediate cylinder such that when the light bulb is energized, ambient light is emitted directly through the front cylinder, the rear cylinder and through the first and second circular gaps.

12. The lamp assembly of claim 11, wherein the intermediate front and rear cylinders are constructed of a rigid, non-transparent material.

13. The lamp assembly of claim 11, wherein the light fixture is connected to the inner wall of the rear cylinder by bracket structure.

* * * * *